US005186107A

United States Patent [19]

Wieland

[11] Patent Number: 5,186,107

[45] Date of Patent: Feb. 16, 1993

[54] DRUM FOR TRANSPORTING SHEETS

[75] Inventor: Erich G. Wieland, Würzburg, Fed. Rep. of Germany

[73] Assignee: Koenig & Bauer Aktiengesellschaft, Wurzburg, Fed. Rep. of Germany

[21] Appl. No.: 926,703

[22] Filed: Aug. 10, 1992

[30] Foreign Application Priority Data

Aug. 12, 1991 [DE] Fed. Rep. of Germany ..... 4126644
Jul. 17, 1992 [DE] Fed. Rep. of Germany ..... 4223555

[51] Int. Cl.[5] ..... B41F 1/30

[52] U.S. Cl. ..... 101/409; 271/276; 271/277; 271/82; 271/195

[58] Field of Search ..... 101/409, 410, 415.1; 271/276, 277, 196, 82

[56] References Cited

U.S. PATENT DOCUMENTS 3,430,946 3/1969 Siebke ..... 271/277
4,024,814 5/1977 Becker ..... 400/410
4,127,265 11/1978 Wirz et al. ..... 101/409
4,357,870 11/1982 Rudolph et al. ..... 271/82
4,395,949 8/1983 Jeschke ..... 271/276
4,660,825 4/1987 Umezawa ..... 271/276
4,790,244 12/1988 Otfried et al. ..... 101/410
5,108,085 4/1992 Smith et al. ..... 271/276

FOREIGN PATENT DOCUMENTS 2419747 4/1974 Fed. Rep. of Germany .
3036790 9/1980 Fed. Rep. of Germany .

*Primary Examiner*—Eugene H. Eickholt
*Attorney, Agent, or Firm*—Jones, Tullar & Cooper

[57] ABSTRACT

A drum for transporting sheets includes a drum base body having a plurality of sheet leading edge grippers and a sheet trailing edge holding part. A plurality of movable suction nozzles are used to smooth the sheet on the surface of the drum and the drum base body and holding part are shiftable circumferentially to stretch the smoothed sheet so that all wrinkles and other defects will be removed from the sheet.

10 Claims, 4 Drawing Sheets

DRUM FOR TRANSPORTING SHEETS

FIELD OF THE INVENTION

The present invention is directed generally to a drum for transporting sheets. More particularly, the present invention is directed to a sheet transport drum having displaceable suction elements. Most specifically, the present invention is directed to a sheet transport drum having displaceable suction elements and movable sheet trailing edge gripping devices. A sheet to be carried by the sheet transport drum is grasped at its leading edge by a plurality of sheet grippers that are not shiftable on the drum. A plurality of displaceable suction nozzles move in a way to smooth the sheet surface on the drum. Once the sheet has been smoothed, a plurality of sheet trailing edge grippers are used to grasp and hold the now smoothed and straightened sheet.

DESCRIPTION OF THE PRIOR ART

Sheet transport and transfer drums are generally well known in the art. These drums are typically used to transfer printed or partially printed sheets from one processing area in a printing press along to another processing area in the press. Typically, these sheet transport drums are provided with one or more axially extending rows of sheet grippers. These sheet grippers open upon actuation by suitable cams and cam rollers to grasp the leading edge of sheets to be transported. Typically, the body of the sheet and its trailing edge merely lie against the surface of the sheet transport drum as it rotates.

In German Patent Specification No. 30 36 790 there is shown a sheet transfer drum for a sheet-fed rotary printing press that uses a gripper device to seize the leading edge of the sheet and further uses a plurality of suction elements for seizing the sheet trailing end. These suction elements aid in straightening and smoothing the sheet. In this prior art device movements generated by adjustable cam drives in directions both parallel and cross to the sheet running direction and applied to the suction elements are such that these suction elements straighten the sheet at the trailing edge in a diagonal direction.

A significant limitation of this prior art device is its lack of ability to completely smooth or remove wrinkles in the paper sheets supported on the surface of the sheet transfer drum. The suction elements move in a diagonal manner with respect to the center line of the sheet in the transport direction or to the drum center axis. These directions of movement of the various suction elements are parallel to each other so that they cross in pairs on the center axis of the drum. This results in a constant straightening of the sheet trailing edge in the direction of the two lateral edges of the sheet. This means that among the individual suction elements, the same distances of the sheets not smoothed are pulled. Since during the smoothing of a sheet which is initially not straight on the drum or which contains wrinkles, as seen from the center line of the sheet in sheet transport direction to the lateral edges of the sheet, a longer distance has to be covered on the lateral edges than in the area of the center line or drum axis, the prior art device does not enable the sheet to be completely smoothed so that not all of the wrinkles are removed. It is also possible that bubble-shaped waves cannot be effectively removed from the sheet by this prior art sheet transfer drum. These bubble shaped waves, which are caused by considerable impressions that are applied to only a partial portion of the sheets during printing, cannot be removed by the prior art devices since the suction elements are not able to transfer the required tensile forces to the sheets.

It will thus be seen that a need exists for a sheet transport drum which overcomes the limitations of the prior art devices. The drum for transporting sheets in accordance with the present invention provides such a device and is a significant improvement over the prior devices.

SUMMARY OF THE INVENTION

It is an object of the present invention to provide a drum for transporting sheets.

Another object of the present invention is to provide a sheet transport drum having displaceable suction elements.

A further object of the present invention is to provide a sheet transport drum having movable sheet trailing edge gripper elements.

Still another object of the present invention is to provide a sheet transport drum having displaceable suction elements which move radially from a point on the leading edge of a sheet.

Yet a further object of the present invention is to provide a drum for transporting sheets whose trailing edges will be straightened in different tensile directions.

Even still another object of the present invention is to provide a sheet transport drum which will remove bubble shaped waves from a sheet.

As will be discussed in greater detail in the description of the preferred embodiment which is set forth subsequently, the sheet transport drum in accordance with the present invention utilizes a plurality of sheet leading edge grippers which are carried by the sheet drum and a plurality of sheet trailing edge grippers that are supported by a rotatable shaft so that they can be shifted circumferentially on the outer surface of the transport drum with respect to the leading edge grippers. A plurality of suction elements engage the sheets being transported and shift both toward the sheet's trailing edge and also toward its lateral sides. This movement of each individual suction element is along a line which radiates from a point on the midpoint of the leading edge of the sheet. The lines of motion of the various suction elements extend out in a radial manner from this central point.

A primary advantage of the sheet transport drum in accordance with the present invention is its ability to properly align and hold the sheet tight against the surface of the drum. This is accomplished despite accelerating and centrifugal forces, air whirls, forces caused by static loading, and paper displacement. The sheets are aligned and held tight on the drum's surface flat and without wrinkles.

The sheets are pulled tight and smoothed radially outwardly and rearwardly from a point which is generally at the middle of the leading edge of the sheet. As the suction elements move toward the rear of the sheet, they also move axially outwardly. This two directional movement of the suction elements applies straightening forces to the sheets which cause them to lie on the drum in a smooth, wrinkle-free manner.

The sheet transport drum of the present invention also removes waves and bubble shaped wrinkles from the sheets being transported. Any waves or other wrinkles that have been imparted to the sheets during the printing process and particularly during the printing of security sheets, which are deformed by the considerable impression forces applied during the printing, are removed from the sheet by the sheet transport drum of the present invention.

The drum for transporting sheets in accordance with the present invention overcomes the limitations of the prior art devices and is a substantial advance in the art.

BRIEF DESCRIPTION OF THE DRAWINGS

While the novel features of the drum for transporting sheets in accordance with the present invention are set forth with particularity in the appended claims, a full and complete understanding of the invention may be had by referring to the detailed description of the preferred embodiments which is presented subsequently, and as illustrated in the accompanying drawings in which:

DESCRIPTION OF THE PREFERRED EMBODIMENT

Figure 1:
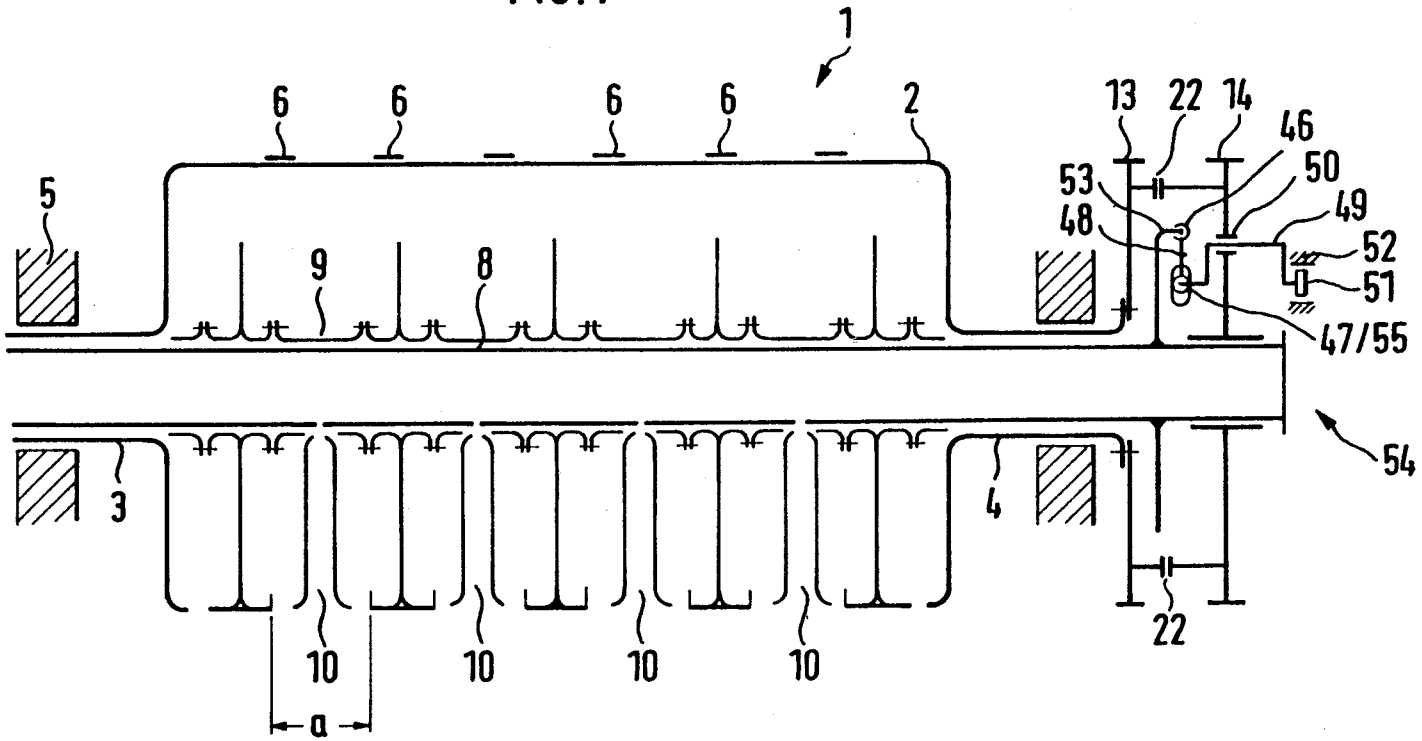
FIG. 1 is a schematic longitudinal cross sectional view of a drum for transporting sheets in accordance with the present invention.

Referring initially to FIG. 1, there may be seen, generally at 1, a sheet transport or storage drum in accordance with the present invention. The drum 1 for transporting sheets includes an outer drum base body 2, and, as will be discussed in greater detail subsequently, also includes a plurality of interleaving or interengaging fork shaped extensions 31 and 32, as may be seen most clearly in FIG. 4. The drum body 2 is supported at its ends by hollow shaft ends 3 and 4. These shaft ends 3 and 4 are rotatably supported in suitable bearings, which are not specifically shown, in press frame members 5. The drum base body 2 is equipped with one or more spaced series of sheet leading end grippers 6, which will not be described in detail since they are of generally conventional construction. These sheet leading end grippers will seize and hold the leading edge of a sheet to be transported by the sheet transport drum 1 from a transfer drum 7 having sheet grippers 16 and positioned intermediate the sheet transport drum 1 and a first printing unit 17, as may be seen specifically in FIG. 2. The sheet transport drum 1 receives the sheets from the first, or upstream sheet transfer drum 7 and transports the sheets to a second or downstream drum 15. The downstream drum 15, which may be a perfecting drum, is provided with a gripper system 18 that is used to feed the sheets to a second printing unit 19. Depending on whether this second printing unit 19 is operating in single-sided or in recto/verso printing, grippers 20 or 21 of the perfecting drum's gripper system 18 will seize either the leading or trailing edge of the sheet being carried on the sheet transport drum 1.

Figure 3:
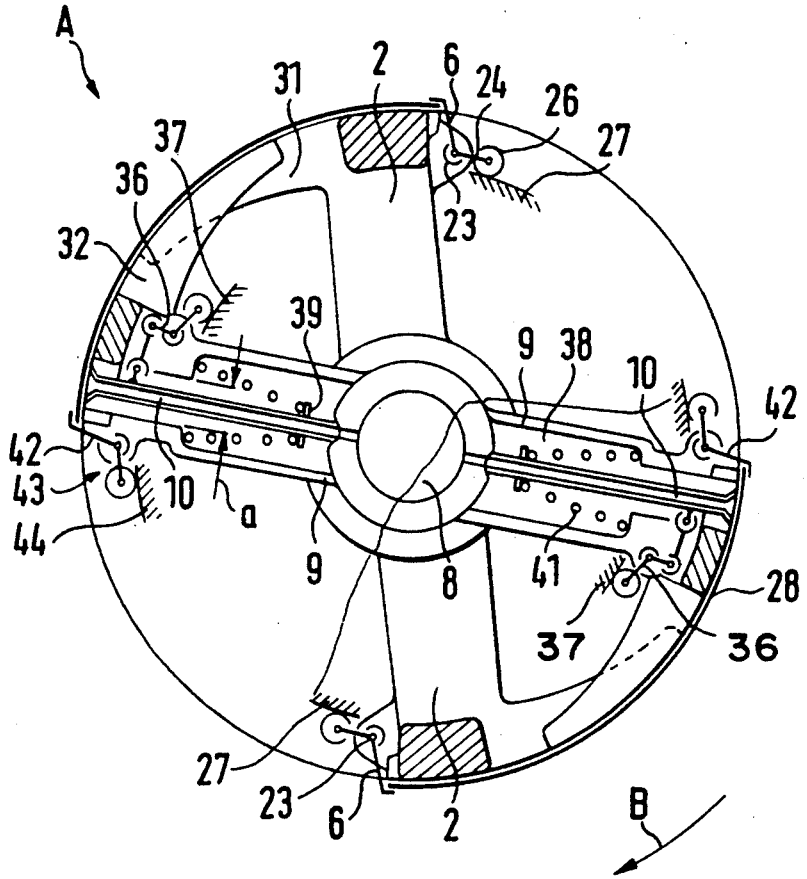
FIG. 3 is an end view of the drum for transporting sheets in accordance with FIG. 1, showing the sheet gripping and suction elements and their drives.
Figure 4:
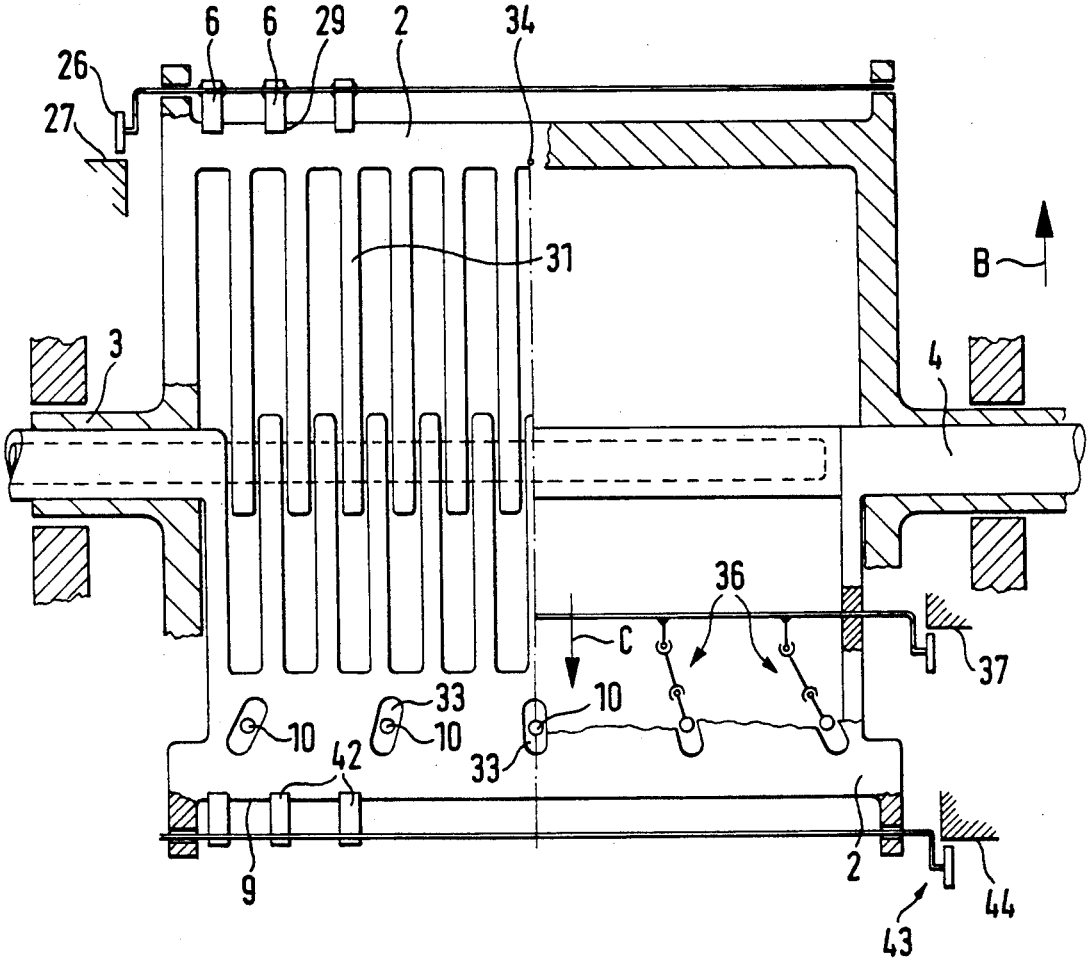
FIG. 4 is a cross-sectional side view of the sheet transport drum and showing the interengaging fingers of the sheet supporting segments which form the sheet support surface of the drum.

Referring again primarily to FIG. 1 as well as to FIGS. 3 and 4, a shaft 8 is supported for rotation in the hollow shaft ends 3 and 4 of the drum base body 2. This shaft 8 has securely attached to it a sheet holding part 9 that has a plurality of sections or segments. Each section or segment of the sheet holding part 9 has one or more radially outwardly extending suction nozzles 10. These suction nozzles 10 are usable to suck the trailing end of a sheet, whose leading edge has been grasped by the sheet leading edge grippers 6, against the outer peripheral surface of the sheet transport drum 1. Each of these individual suction nozzles 10 is supplied with suction air through the shaft 8, which is constructed as a hollow shaft and which is, in turn provided with suction air through a generally known suction air rotary union.

Again referring to FIG. 1, a first toothed gear wheel 13 is secured to a flange on the hollow end 4 of the drum base body 2. A second toothed gear wheel 14 is secured to an end of the hollow shaft 8 which extends beyond the hollow end 4 of the drum base body 2. Both of these toothed gear wheels 13 and 14 are of the same diameter, have the same number of teeth and the same pitch and are positioned generally parallel to each other. As indicated above, the first toothed gear wheel 13 is securely fastened to the hollow shaft end 4 of the drum base body 2. The second toothed gear wheel 14 is rotatably supported on the hollow shaft 8 and is connected through a disengageable coupling 22 to the first toothed gear wheel 13. This coupling 22 may be of a type described in detail in the German published unexamined patent application No. 35 34 486.

Figure 2:
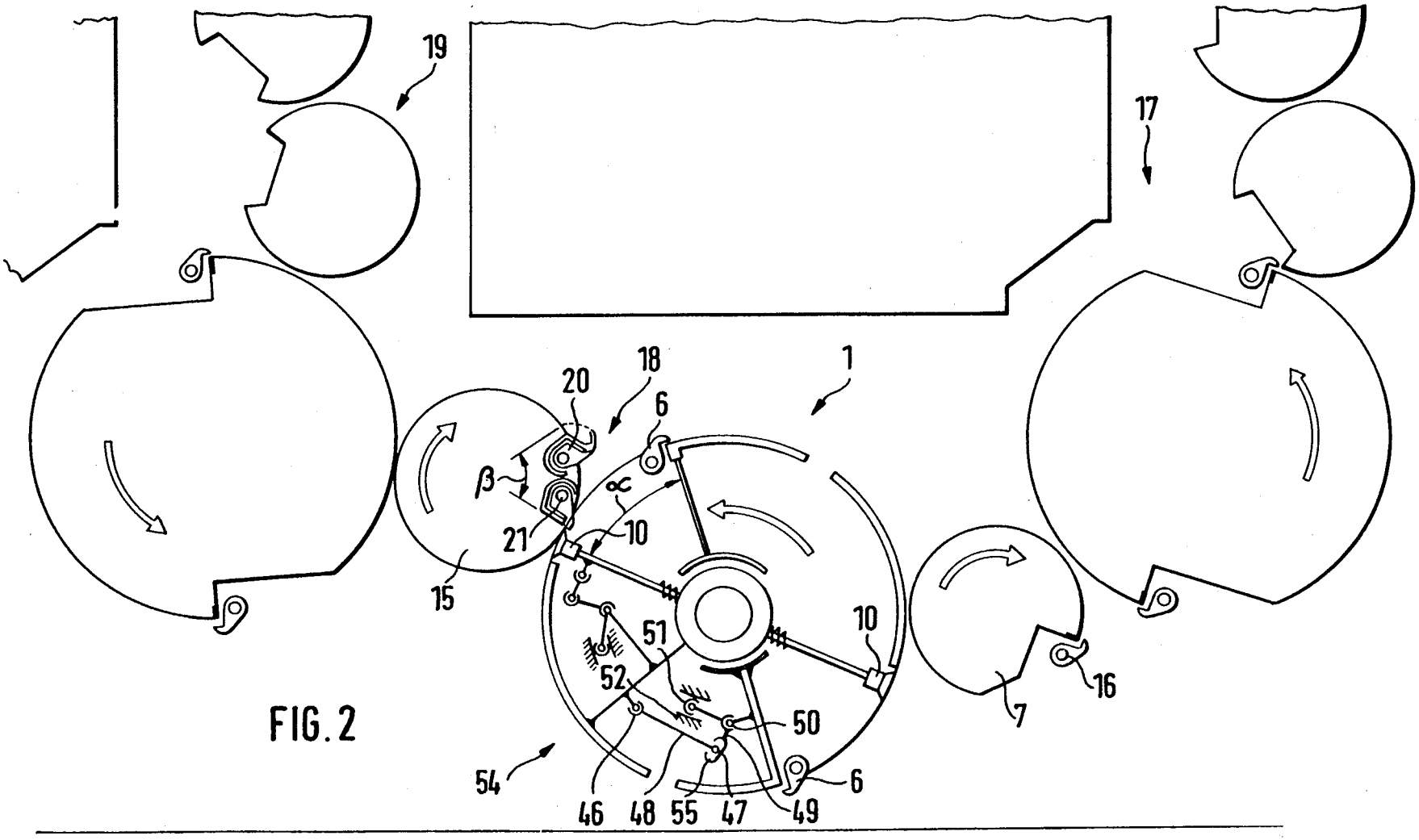
FIG. 2 is a schematic side view showing a drum of the present invention between two printing units.

The second toothed gear wheel 14 is also connected to a lever 53 which is secured to the end of the hollow shaft 8. As seen in FIG. 1, and as is also seen in FIG. 2, a pair of joints 46 and 47 are connected by a connecting rod 48 which extends between them. A lever 49, which is in the shape of a crankshaft, carries a crankshaft roller 51 at a first end and is secured to the joint 47 at a second end. The roller 51 travels in a cam groove 52 in the press frame 5. The second end of the lever 49 is provided with a slot 55 which carries the joint 47. This joint 47 may slide in the slot 55 or may be fixed at a specific location in slot 55. The slotted end of the crankshaft shaped lever 49 acts as a hinge point for lever 49. A bearing 50 in the second toothed gear wheel 14 supports the crankshaft lever 49 intermediate its ends and allows lever 49 to pivot with respect to its hinge joint 47 to accommodate movement of the crankshaft lever 49 caused by the crankshaft roller 51 riding in the groove 52. This assemblage of joint 46, joint 47, connecting rod 48, crankshaft lever 49, bearing 50, roller 51, groove 52 and lever 53 form a drive unit 54 which is operable to cause an oscillating movement in the direction indicated by arrow C in FIG. 4 of the holding part 9, which oscillating movement is superimposed over the rotation of the hollow shaft 8. This oscillating movement of the holding part 9 in turn, causes an oscillating movement of sheet trailing edge grippers 42 which are supported on the holding part 9 and also of the suction nozzles 10.

A tooth wheel of sheet transfer drum 7 meshes with the toothed gear wheel 13 which is fixed on the hollow shaft end 4 of the drum base body 2. The toothed gear wheel 14, which is carried on the hollow rotatable shaft 8, meshes with a toothed gear wheel on the perfecting drum 15. A plurality of stops, which are not specifically shown in the drawings, are provided between the toothed gear wheels 13 and 14 or the two parts of the sheet transport drum; i.e. drum base body 2 and holding part 9 which are rotatable relative to each other, and the sheet transfer drum 1. If the sheet transfer drum 1 is set to a single-sided printing operation, these stops are in contact with each other. These stops thus maintain the single-sided printing position in which the grippers 20 of the gripper system 18 of the perfecting drum 15 correspond with the grippers 6 of the sheet transport drum 1. If the printing press assembly is to be changed from perfecting to single-sided printing it is only necessary to move these stops to each other. In the single sided printing position which corresponds to the basic position, the sheet distance on the sheet transfer drum 7 corresponds to the sheet distance of the perfecting drum 15 while the length of the sheet distance results from the displaced distance of the sheet trailing edge during reversing minus the paper margin required to grip the sheet.

Turning now to FIG. 3 the structure of the sheet transport drum 1 of the present invention, as has been depicted somewhat schematically in FIGS. 1 and 2, will be shown in a more specific manner. The drum base body 2 carries a plurality of sheet grippers 6 which are used to grasp and hold the leading edge of a sheet. A leading edge sheet gripper roller 26 rides on a control cam surface 27 fixed to the press frame. The movement of gripper roller 26 moves a first end of a lever 24 which is pivotably supported in bearings 23 that are secured to the drum base body 2 adjacent its periphery. The second end of the pivotable lever 24 carries the sheet leading edge grippers 6 which cooperate with gripper pads 29 to clamp the leading edge of a sheet 28 that is to be transported by sheet transport drum 1 from transfer drum 7 to perfecting drum 15. As may be seen in FIG. 3, and as is shown more clearly in FIG. 4, the gripper pad 29 has a plurality of circumferentially extending fork-shaped extensions or fingers 31. These sheet leading edge gripper pad fingers 31 form a portion of the outer peripheral surface of the sheet transport drum 1.

A plurality of sheet trailing edge grippers 42 are secured to the outer periphery of the holding parts 9. As seen in FIG. 3, these trailing edge grippers 42 are operated by sheet trailing edge gripper control cams 44 which are secured to the press frame. A trailing edge sheet gripper drive, generally at 43, which is generally similar to the sheet gripper leading edge drive discussed previously, is used to open and close the sheet trailing edge grippers 42 as the sheet transport drum 1 revolves. This drive 43 consists of a gripper shaft and a cam follower roller which is in contact with the central cam 44. The sheet trailing edge grippers 42 grip the trailing edge of a sheet 28 and hold the sheet 28 against the trailing edge of the holding part 9. As may be seen in FIGS. 3 and 4, the holding part 9 includes a plurality of holding part fork shaped extensions or fingers 32 which interdigitate with the sheet leading edge gripper pad fingers 31 to form the peripheral surface of the sheet transport drum 1.

Again referring to FIGS. 3 and 4 the plurality of suction nozzles 10 have radially outer ends that are guided in angled slots 33 which are formed in the peripheral outer surface of the sheet trailing end holding part 9. These outer ends of the suction nozzles 10 are movable generally in the direction indicated by arrow C in FIG. 4. It will be noted that the plurality of longitudinally extending slots 33 are arranged in a radially outwardly or fan-shaped array with the longitudinal axes of the plurality of slots converging at a reference point 34. This reference point 34 is located at the midpoint of the leading edge of a sheet 28 which is held by the sheet leading edge grippers 6. As the suction nozzles 10 move radially outwardly and circumferentially toward the trailing edge grippers 42 in the direction indicated by arrow C in FIG. 4, a sheet 28 positioned on the sheet transport drum 1 will be straightened towards its outer and trailing edge.

The radially inner end of each suction nozzle 10 is generally ball-shaped and is pivotably carried in a cooperatively shaped recess in the hollow shaft 8, and is aligned with a suction air port, as seen in FIG. 3. A shoulder 39 is attached to each suction nozzle 10 generally near its radial inner end. This shoulder is engaged by a first end of a conical pressure spring 41. An outer end of each pressure spring 41 abuts a rim of a tapered recess 38 in the sheet trailing end holding part 9.

As may also be seen in FIG. 3, the suction nozzles 10 are shiftable in their longitudinally extending guide slots 33 through a distance "a" by means of a suction nozzle drive assembly 36 which is driven by a cam 37 that is fixed in the press frame. The suction nozzle drive assembly 36 includes a bracket on the suction nozzle which is connected by way of a ball and socket joint to a connecting rod which is activated through a toggle lever and a roller that rides on the control cam 37.

In operation, once the leading edge of a sheet 28 has been gripped by the leading edge sheet grippers 6, it will be smoothed onto the outer periphery of the sheet transport drum 1 by movement of the suction nozzles 10 radially outwardly and circumferentially toward the sheet trailing edge grippers 42. This smoothing of the sheets 28 by the suction nozzles 10 brings the sheet trailing edge into position to be grasped by the trailing edge grippers 42. Once the sheet trailing edge has been so grasped, the entire sheet trailing edge holding part 9 will move in a direction opposite to the direction of rotation of the sheet transport cylinder 1 and away from the fixed position of the corresponding sheet leading edge grippers 6. This shifting of the position of the holding part 9 with respect to the drum base body 2 by a distance of 0.1 to 1.0 mm will effectively stretch the sheets 28 by this same amount so that wrinkles, cockling, and wavy sheets will lie completely flat on the interdigitating fingers 31 and 32.

The stretching movement of the sheet trailing edge holding part 9, which is equipped with the sheet trailing edge grippers 42, with respect to the drum base body 2, equipped with the sheet leading edge grippers 6, is generated by actuation of the drive unit 54 which has been described in detail previously in the specification. The sheet trailing edge grippers 42 move on a circular arc whose radius corresponds to that of the sheet transport drum 1. As the crankshaft roller 51 runs in its cam groove 52 in the press frame, the crankshaft lever 49 transfers a force acting on the holding part 9 which is connected to hollow shaft 8 by way of connecting rod 48 which is supported in a hinge in such a way that the holding part 9 effects a pivoting movement with respect to the drum base body 2. If the amount of stretching of the sheet is adjustable, an adjustable control cam can be substituted for the cam groove 52. In this case, the crankshaft lever 49 and its associated roller 51 will be spring biased against the adjustable control cam.

In FIG. 4, as was discussed previously, the point of intersection 34 of the plurality of longitudinal axes of the elongated slots 33 which guide the outer ends of the suction nozzles 10 is located on the circumferential line of drum 1 and preferably at the center of the circumferential line. It is possible to locate this reference point 34 in the area of the sheet leading edge gripper pad or about 10 to 15 mm outside the pad of gripper 6 depending on which angles are created by the extended longitudinal axes of the slots 33. This reference point 34 may even be located more than 10 to 15 mm outside the pad of the sheet leading edge gripper 6.

While a preferred embodiment of a drum for transporting sheets in accordance with the present invention has been set forth fully and completely hereinabove, it will be apparent to one of skill in the art that various changes in, for example the overall size of the drum, the number of sets of sheet leading and trailing edge grippers, the source of suction air and the like can be made without departing from the true spirit and scope of the present invention which is accordingly to be limited only by the following claims.

What is claimed is:

1. A drum for transporting a sheet between spaced printing units in a sheet fed rotary printing press, said drum comprising:

a drum base body having a plurality of sheet leading edge grippers and being rotatably supported;

a rotatable shaft supported in said drum body for rotation relative to said drum body;

a sheet trailing edge holding part secured to said rotatable shaft and having a plurality of sheet trailing edge grippers; and a plurality of sheet smoothing suction nozzles pivotably supported in said holding part, said plurality of suction nozzles having individual lines of movement which intersect at a reference point.

2. The drum of claim wherein said reference point is located on a central circumferential line of said drum.

3. The drum of claim wherein said reference point is located in the area of a gripper pad for said sheet leading edge grippers.

4. The drum of claim 1 further including means to circumferentially shift said holding part with respect to said drum base body to sketch a sheet secured to said drum.

5. The drum of claim 4 wherein said holding part is shiftable on an arc having a radius corresponding to a radius of said drum.

6. The drum of claim 4 wherein said sheet trailing edge holding part is shiftable by a drive unit.

7. The drum of claim 6 wherein said drive unit includes a lever arm secured to said rotatable shaft and being connected to a control roller riding in a control cam groove by a connecting rod and a crankshaft lever.

8. The drum of claim 1 wherein a radially inner end of each of said suction nozzles has a ball shape and is received in a correspondingly shaped seat on said rotatable shaft.

9. The drum of claim 8 further including a pressure spring for holding said inner end of said suction nozzle in said seat.

10. The drum of claim 1 wherein said holding part includes a plurality of elongated slots and further wherein radially outer ends of said suction nozzles are disposed in said elongated slots.

* * * * *